US005947333A

United States Patent [19]

Hoffmann et al.

[11] Patent Number: 5,947,333

[45] Date of Patent: Sep. 7, 1999

[54] BULK BAG DISCHARGE SYSTEM AND METHOD

[75] Inventors: Jeffrey R. Hoffmann; David F. Hesketh; Andrew M. Davis, all of Monroe, N.C.

[73] Assignee: Hoffman, Monroe, N.C.

[21] Appl. No.: 09/030,074

[22] Filed: Feb. 25, 1998

[51] Int. Cl.[6] ..... B67D 5/06; B65G 1/00; B65B 21/02

[52] U.S. Cl. ..... 222/105; 222/185.1; 222/196; 414/291; 414/403; 414/415

[58] Field of Search ..... 222/105, 185.1, 222/181.1, 460, 543, 181.3, 196; 414/291, 403, 415

[56] References Cited

U.S. PATENT DOCUMENTS

| | | | |
|---|---|---|---|
| 3,007,608 | 11/1961 | Cox, Jr. . | |
| 3,372,725 | 3/1968 | Voorhees . | |
| 3,374,929 | 3/1968 | Silfverskiöld . | |
| 3,430,815 | 3/1969 | Weimer et al. . | |
| 4,113,146 | 9/1978 | Williamson . | |
| 4,516,693 | 5/1985 | Gaston . | |
| 4,646,944 | 3/1987 | Sanderson . | |
| 4,735,543 | 4/1988 | St. Lawrence | 414/421 |
| 4,817,824 | 4/1989 | LaFleur et al. . | |
| 4,863,065 | 9/1989 | Decrane . | |
| 4,946,071 | 8/1990 | Poulton . | |
| 4,966,311 | 10/1990 | Taylor | 222/105 |
| 5,018,877 | 5/1991 | Kantz . | |
| 5,033,706 | 7/1991 | Poulton . | |
| 5,101,868 | 4/1992 | Balch . | |
| 5,102,010 | 4/1992 | Osgar et al. . | |
| 5,105,981 | 4/1992 | Gehman . | |
| 5,131,571 | 7/1992 | Nolley . | |
| 5,320,251 | 6/1994 | Ellis . | |
| 5,333,757 | 8/1994 | Volk et al. . | |
| 5,415,323 | 5/1995 | Fenelon . | |
| 5,494,189 | 2/1996 | De Crane | 222/1 |
| 5,531,360 | 7/1996 | Berdel et al. | 222/185.1 |
| 5,642,939 | 7/1997 | Comardo | 366/132 |

OTHER PUBLICATIONS

Flexicom Corporation information for "Bulk Bag Dischargers and Weigh Batching Systems" (3 pages) No Date Avail.

Flexicom Corporation information entitled "Design Advantage" re Series BFF and BFC Bulk Bag Dischargers No Date Avail.

*Primary Examiner*—Andres Kashnikow
*Assistant Examiner*—Kants Quinalty
*Attorney, Agent, or Firm*—Adams Law Firm, P.A.

[57] ABSTRACT

A bulk bag discharger is disclosed having an inner product tube for receiving the discharge spout on the bottom of the bulk bag, the tube being housed within an outer chamber that traps and retains foreign material and contaminants that could otherwise fall into the clean product zone. The result is discharge of product from within the bulk bag with minimal contamination from the outer bag.

7 Claims, 10 Drawing Sheets

BULK BAG DISCHARGE SYSTEM AND METHOD

BACKGROUND OF THE INVENTION

The present invention relates to bag discharge systems and, more particularly, to a bulk bag discharge system and method that minimizes contamination transferred to the bag contents.

Bulk bags are used in many industries to transport large quantities of products, such as pharmaceuticals, bulk chemicals, and food products. Bulk bag applications in the food industry are generally non-sanitary, which means that microbial growth, especially salmonella, botulism, and certain molds, are not expected. This is the case with sugar, salt, flour, flavorings, and baking soda which are commonly handled food ingredients that do not require sanitary equipment.

However, there are several materials, particularly meat and dairy products, which lend themselves to use with bulk bags that would require sanitary discharge equipment. For example, dairy and meat products must meet sanitary standards as defined by the United States Department of Agriculture, because they harbor bacteria or mold spores that can become active and multiply if provided with adequate moisture, temperature, and time.

Bulk bags are typically made from woven polyester, polypropylene, or other polymer, and can typically hold up to about 2,000 pounds. The dimensions are typically 42"×42"×42", with an 18-inch diameter spout that is about 16 inches long at the bottom center. An inner disposable plastic liner not attached to the bag is often used as a boundary to moisture and dirt, allowing the bag to be reused by providing a different inner plastic liner for each subsequent use. Sometimes, such liners are provided attached to the inside of the bag. Generally, the bag has four loops, one in each corner at the top of the bag, that are used to lift and transport the bulk bag with a lifting device such an overhead hoist or forklift.

The bag is generally filled through a fill spout located in the top of the bag. The fill spout is secured, such as by tying a cord around the spout, after the fill is completed. Discharge requires lifting the bag, pulling a bottom spout down and away from the bag, and untying or cutting a tie that secures the bottom spout. Once the tie is removed, the bag spout is opened and the inner liner is pulled down. Upon untwisting, untying, or unknotting the liner, solids will flow down by gravity and out of the bag.

Known bulk bag discharge systems have a lack of sanitation when the contents of the bag are discharged, because contaminants on the outside and the bottom of the bag (e.g., dirt, insects, loose threads, rodent feces, hair, etc.) fall into the discharge system and become entrained in the clean product exiting the bag spout. Known bag dischargers also have no provision for quick disassembly or easily cleaned components that allow routine cleaning and elimination of microbial growth, exacerbating the sanitation problem. Because of these sanitation problems with known bulk bag dischargers, none have been certified as approved by the United States Department of Agriculture for use in sanitary applications with dairy or meat products, nor do they comply with the Dairy Industry 3A standards of sanitation.

It is desirable to provide a bulk bag discharger and discharging system that comply with sanitary standards established by the United States Department of Agriculture and the Dairy Industry 3A standards of sanitation to allow the use of bulk bags in applications for foods, such as dairy and meat products, that are required to be maintained in sanitary conditions, It would also be desirable to provide a bulk bag discharge system that is quickly disassembled and easily cleaned such that microbial growth would be discouraged to aid in maintaining a suitable level of sanitary conditions for use with foods, etc., requiring sanitary conditions.

BRIEF SUMMARY OF THE INVENTION

It is an object of the present invention to provide a bulk bag discharge system and method of discharging that minimizes contamination of the contents of the bag during discharge from the bag. It is a further object of the present invention to provide such a system and method to meet sanitary standards established by the United States Department of Agriculture for food products, such as dairy and meat products, that require high levels of sanitation and to receive United States Department of Agriculture approval for use with dairy and meat products, and further to meet the Dairy Industry 3A cleanliness requirements. It is a further object of the present invention to provide a system and method of discharging bulk solids from within a bulk bag such that the same system may be reused with different bags while minimizing the possibility of cross-contamination from one bag to the next. It is yet a further object of the present invention to provide an easily cleaned bulk bag discharge system where residual materials in the discharge system can be readily cleaned from the system with minimal exposure to the operator.

In order to provide these objects and advantages, the bulk bag discharge system and method of the present invention has a bag lifting frame from which the bulk bag is suspended by four loops attached thereto. This frame is used for transporting the bag by forklift or overhead crane. The bag lifting frame is placed on top of a spring-loaded side tensioning frame. A support frame with support legs is attached to the tensioning frame and rests upon the floor.

An outer chamber attached to the support frame is positioned below the bulk bag and has a bag support dish having a center opening disposed to support the bag, with the bag spout positioned through the center opening. The outer chamber is also provided with an access hatch opening to provide access to the interior of the outer chamber. The access hatch opening may be closed by an access hatch.

The inner chamber is provided with an inner product tube and a spout adapter attachable to the inner product tube to accommodate a spout from the bag and a liner from the bag. The inner product tube is disposed such that it extends through the bottom of the outer chamber in sealed relation thereto. The product will discharge through the inner product tube to the end use.

Pinch bars may also be provided to close the bag spout within the outer chamber. Also, a bag massage device may be provided to stimulate the bulk bag to enable discharge of clumped or compressed material from within the bag.

In operation, the loops of the bulk bag are fitted over the bag lifting frame and elevated with a forklift or hoist in position over the bag support dish and lowered onto the dish with the bag spout passing through the center opening in the dish. Simultaneously, the bag, lifting frame is caused to rest on the top of the spring-loaded side tensioning frame, causing it to compress between about 6 inches and about 18 inches. The access hatch is opened and the bag spout is grasped and pulled downward. The bag spout is untied and pulled fully down and out to spread beyond the diameter of the spout adapter fitted on the top of the inner product tube.

Then the operator reaches up into the bag spout and pulls a bag liner down from inside the bag spout. If pinch bars are employed, at this point the spout is pinched sufficiently to stop any flow of material from the spout.

The liner is then untied and simultaneously pulled down and over the outside of the spout adapter. A quick-release spout adapter clamp is then placed around the liner and secured to the top of the spout adapter, sealing the liner to the spout adapter. Then the access hatch is closed and secured. If used, the pinch bars are retracted at this point. Solids can now be withdrawn from the inner product tube by whatever means the user has attached to the device (e.g., conveyor, hopper, or other process device). If a bag massage is employed, it may be utilized at this time to assist in the promotion of flow of the solids.

After all or nearly all solids have been removed from the bulk bag, the device can be easily disassembled for cleaning. The pinch bars, if used, are utilized to pinch the bag spout shut. The access hatch is opened and the liner securing clamp is removed and the bag spout is retied. If used, the pinch bars are, at this time, retracted from the spout. The bulk bag may now be removed from the bag support dish.

The inner product tube is then disconnected from the user's process (e.g., conveyor, hopper, or other process device), and the spout adapter securing clamp and spout adapter are removed from the inner product tube. The inner product tube retaining clamp and the inner product tube are removed from the outer chamber. The system can now be swept dry or washed according to commonly accepted cleaning procedures. All solids can be swept out of the outer chamber or liquids drained from the outer chamber. In this way, the bag discharge system is easily disassembled without the use of tools and can be thoroughly cleaned so that there is no cross-contamination between the products discharged from one bag and the products discharged from a subsequent bag. Further, such cleaning inhibits any growth of bacteria or mold spores that would cause an unsanitary condition.

DETAILED DESCRIPTION OF THE INVENTION

Figure 1:
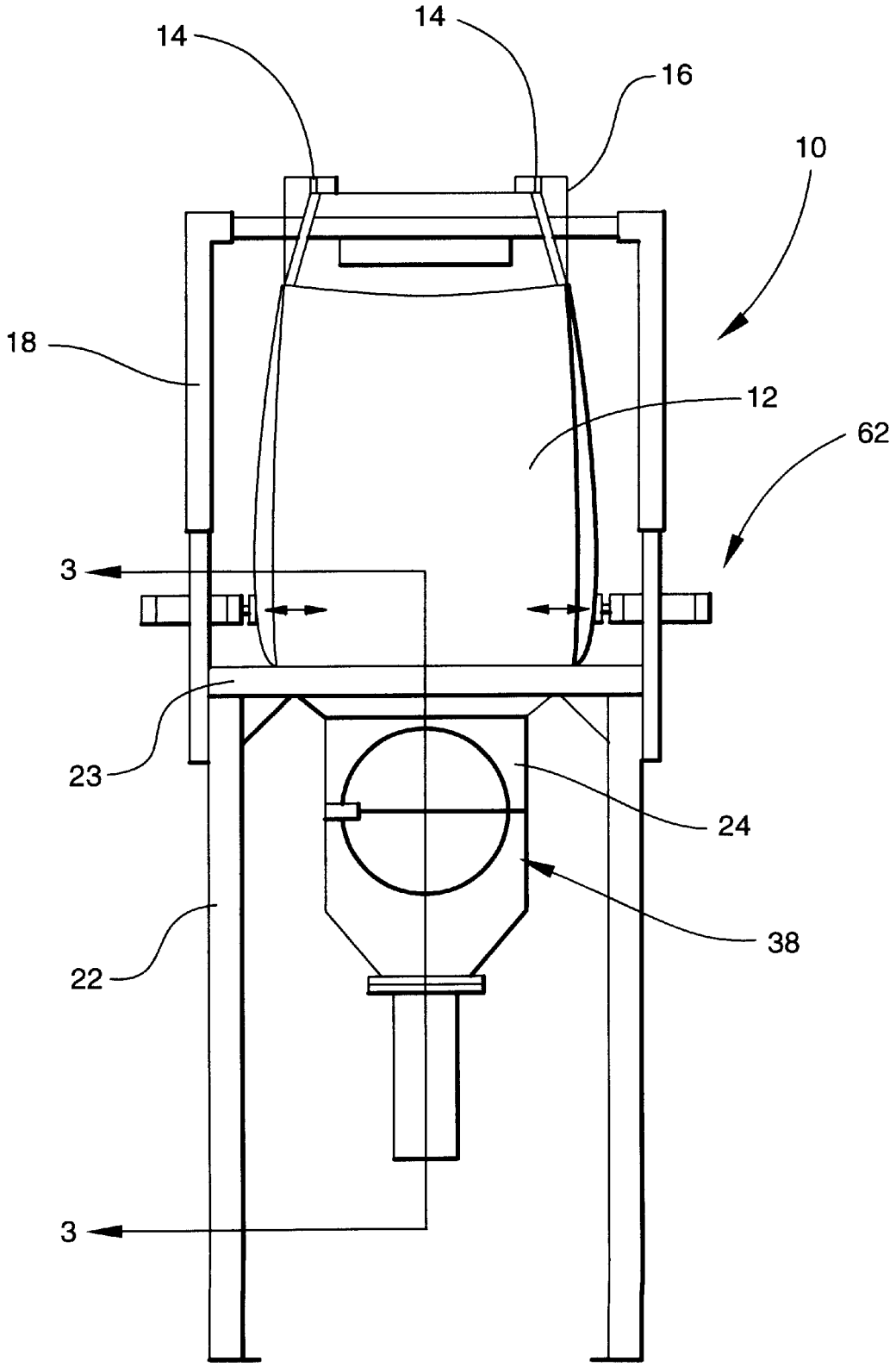
FIG. 1 is an elevational view of a bulk bag discharge system embodying the present invention.
Figure 2:
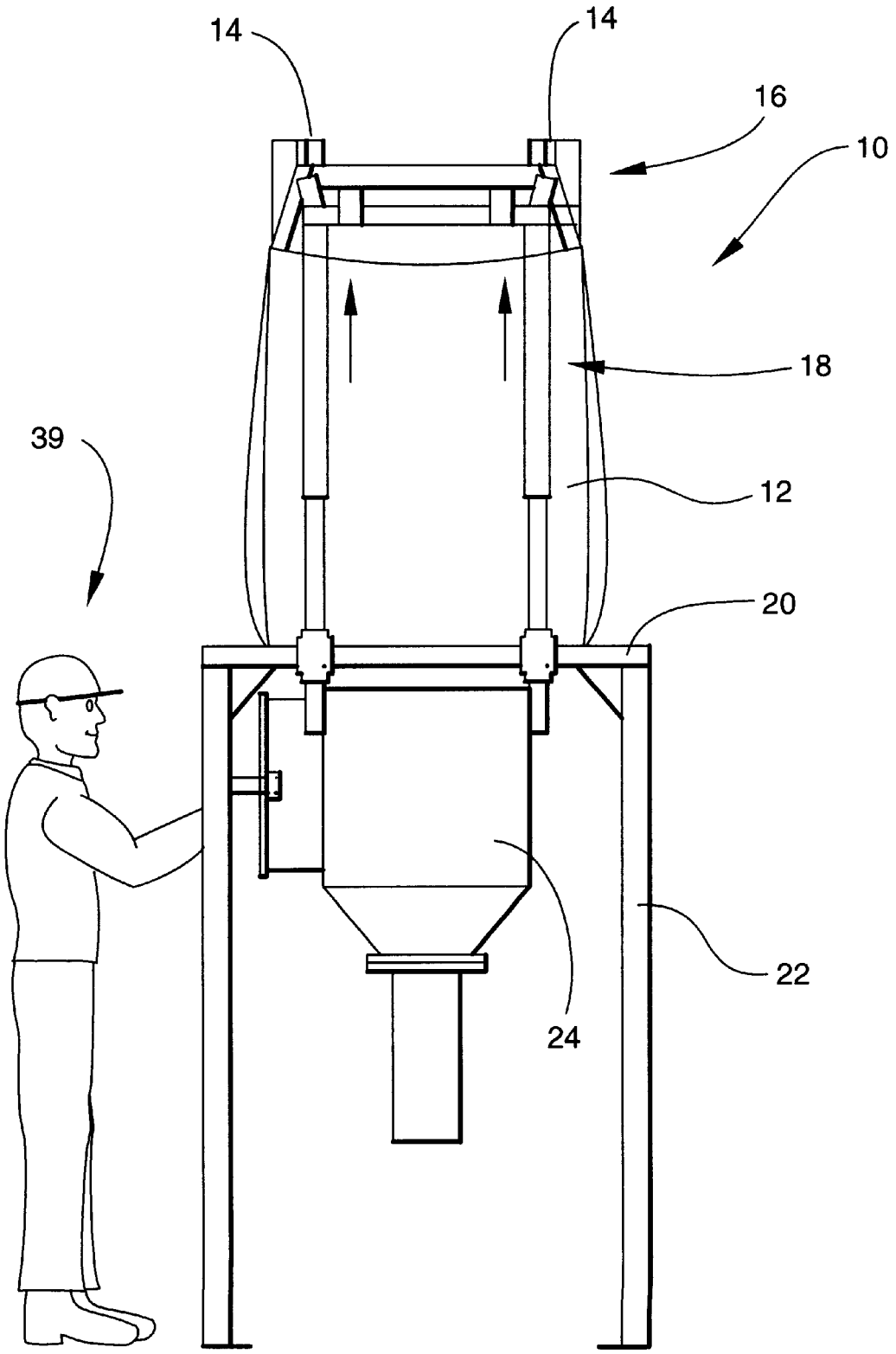
FIG. 2 is a side elevational view of the discharge system of FIG. 1.

The present invention is a bulk bag discharge system 10 and a method for discharging bulk product 11 from within a bulk bag. As illustrated in FIGS. 1 and 2, a bulk bag 12 is supported by four loops 14 attached thereto and looped over a bulk bag lifting frame 16. The lifting frame 16 is then engaged by a forklift or overhead crane (not shown) to pick up the bulk bag 12 and transport it. The lifting frame 16 is placed on top of a conventional spring-loaded side tensioning frame 18 which is attached to a support frame 20 having four support legs 22 such that the bag 12 is suspended at a predetermined height.

An outer chamber 24 is attached to the support frame 20 and provides a zone for containment of contaminants and a dust-tight chamber for discharge of product 11. As illustrated best in FIGS. 3 and 4, the upper part of the outer chamber 24 is provided with a hollow frustoconical bag support dish 26. The dish 26 has an 18-inch diameter hole at the narrow end of the hollow frustum through which a bulk bag spout 28 may extend, and extends conically outward from the top of the outer chamber 24 for supporting the bulk bag 12. The 18-inch diameter hole in the center of the bag support dish 26 corresponds to the opening at the top of the outer chamber 24, allowing the bulk bag spout 28 to extend therethrough.

The lower end of the outer chamber 24 is provided with a hollow frustoconical self-draining portion 30 that extends inwardly from the circumference of the otherwise generally cylindrical outer chamber 24. This provides a sloped surface within the outer chamber 24, allowing for easy cleaning of the interior of outer chamber 24.

The lower end of the frustoconical self-draining portion 30 terminates in a cylindrical portion 32 and a bottom opening 34. A bottom flange 35 or other clamp mounting device is provided around the exterior of the bottom opening 34 at the termination of the lower end of the cylindrical portion 32.

The outer chamber 24 is also provided with an access hatch opening 36 which may be closed and sealed by an access hatch 38. The access hatch opening 36 allows access to the interior of the outer chamber 24 so that an operator 39 may make the proper connections within the interior of the outer chamber 24 when the bulk bag 12 is disposed in the bag support dish 26 and the bulk bag spout 28 extends into the interior of the outer chamber 24.

An inner product tube 40 is provided to extend upwardly through the bottom opening 34 into the interior of the outer chamber 24. The inner product tube 40 provides the conduit through which the clean product 11 from the bulk bag 12 passes. The inner product tube 40 is provided with a flange 42 or other clamp mounting device such that, when the inner product tube 40 extends through the bottom opening 34, the flange 42 abuts the bottom flange 35 and is secured in place by an inner product tube clamp 44. This is quick-release clamp and is used to secure the inner product tube 40 to the cylindrical portion 32 of the outer chamber 24 at the bottom opening 34 with the bottom flange 35. This serves to form a seal at the bottom opening 34 such that none of the product 11 from within the bulk bag 12 or within the interior of the outer chamber 24 may pass outside of the outer chamber 24, except through the interior of the inner product tube 40. In a preferred embodiment, the inner product tube 40 is substantially cylindrical with a diameter of about 8 inches to about 16 inches and has a top flange 46 or other clamp connection on the top thereof to accept a spout adapter 48.

The hollow frustoconical spout adapter 48 is attached to the inner product tube 40 at the narrow end of the spout adapter 48 with a spout adapter clamp 50. The bag spout adapter 48 may also be cylindrical; however, the frustoconical shape aids in the discharge of material through and into the inner product tube 40. The spout adapter clamp 50 is a conventional quick-release clamp of the type that may be connected and disconnected without the use of any tools, and that are well known in the art.

Most bulk bags 12 are provided with a disposable bag liner 56 into which the product 11 is actually placed during fill such that the bulk bags 12 may be reused with different bag liners 56 with a minimum of cross-contamination. The bag liner 56 and the bulk bag spout 28 are generally individually tied or otherwise secured to prevent undesirable discharge of the product 11 contained within the bulk bag 12 and the bag liner 56.

The wide, top end of the spout adapter 48 is also provided with a clamp connection 52 to accommodate a liner clamp 54. The liner clamp 54 is preferably used to secure the bag liner 56 around the outside of the spout adapter 48 to the clamp connection 52 so that, when product is discharged from the bag liner 56 in the bulk bag 12, it travels through the spout adapter 48 and into the inner product tube 40, through which it travels to the end use (e.g., conveyor, hopper, or other process device). Other securing devices may also be used to secure the bag liner 56 to the spout adapter 48 and provide for a seal therebetween such that product 11 does not generally flow outside the inner product tube 40.

The spout adapter 48 is provided with a spout adapter cover 58 to be placed on the top of the spout adapter 48 to prevent contaminants from falling into the inner product tube 40 while loading the bulk bag 12 into the bag support dish 26 and until the bag spout 28 is untied. The cover 58 is removed only just before untying the bag liner 56 to secure the bag liner 56 to the spout adapter 48 at the clamp connection 52. Because the bag liner 56 is secured, such as by the liner clamp 54, to the outside of spout adapter 48, product 11 from the bag 12 does not generally flow outside the inner product tube 40 and into the interior of the outer chamber 24, as is commonly encountered in conventional designs, but must flow only into and through the inner product tube 40. Thus, the product 11 is not exposed to any outside contamination.

In a preferred embodiment, conventional pinch bars 60 of a type well known in the art are provided to move horizontally toward one another to close the bag spout 28 while untying the bag liner 56. The pinch bars 60 may also be used to control the flow of product 11 from the bulk bag 12 during discharge. The pinch bars 60 may also be used to pinch the bag spout 28 closed before the contents are entirely emptied from the bulk bag 12, thus securing discharge. Preferably, the pinch bars 60 are pneumatically driven. The use of pinch bags is particularly appropriate for some materials, such as sugar, that are difficult to manually prevent from discharging when the bag liner 56 is untied.

Also, a conventional bag massage device 62 of a type well known in the art may be provided to massage and manipulate the bags in order to promote the flow of the product 11 from within the bulk bag 12 (see FIG. 1). Often, many materials will not flow from the bag 12, especially after being compressed during shipping and stacking, so the bag massage device 62 is provided to prevent product 11 becoming stuck within the bag 12 and not flowing properly. Preferably, the bag massage device 62 is pneumatically driven. Such bag massage devices are known in the art.

As the product 11is discharged from the bag liner 56 within the bulk bag 12, the bag liner 56 may be drawn down through the bulk bag spout 28 with the product 11 being discharged from within the liner 56 because the bag liner 50 is seldom attached to the interior of the bag 12. To eliminate the possibility that the liner 56 accompanies the product 11 as it is being discharged, an upper liner clamp (not shown) may be provided on the bag lifting frame 16 or the spring-loaded side tensioning frame 18 to secure the top of the bag liner 56 and prevent such undesirable discharge of the bag liner 56.

All of the clamps and connectors made in the system 10 are made without tools so that assembly and disassembly may be easily and quickly accomplished. The clamps are conventional quick-release clamps that are well known in the art. This rapid assembly and disassembly feature facilitates cleaning so that any residual material will not contaminate subsequent bags or the materials contained therein.

It will also be noted that the bag spout 28 and the bag liner 56 may be secured in a variety of ways, such as by tying a knot in the bag or liner, wrapping a tie (metal, plastic, woven, string, etc.) around the spout 28 or liner 56, clamping, etc. It is not intended that the invention be limited by any particular method or apparatus used to secure flow from the bag spout 28 or bag liner 56.

Figure 6:
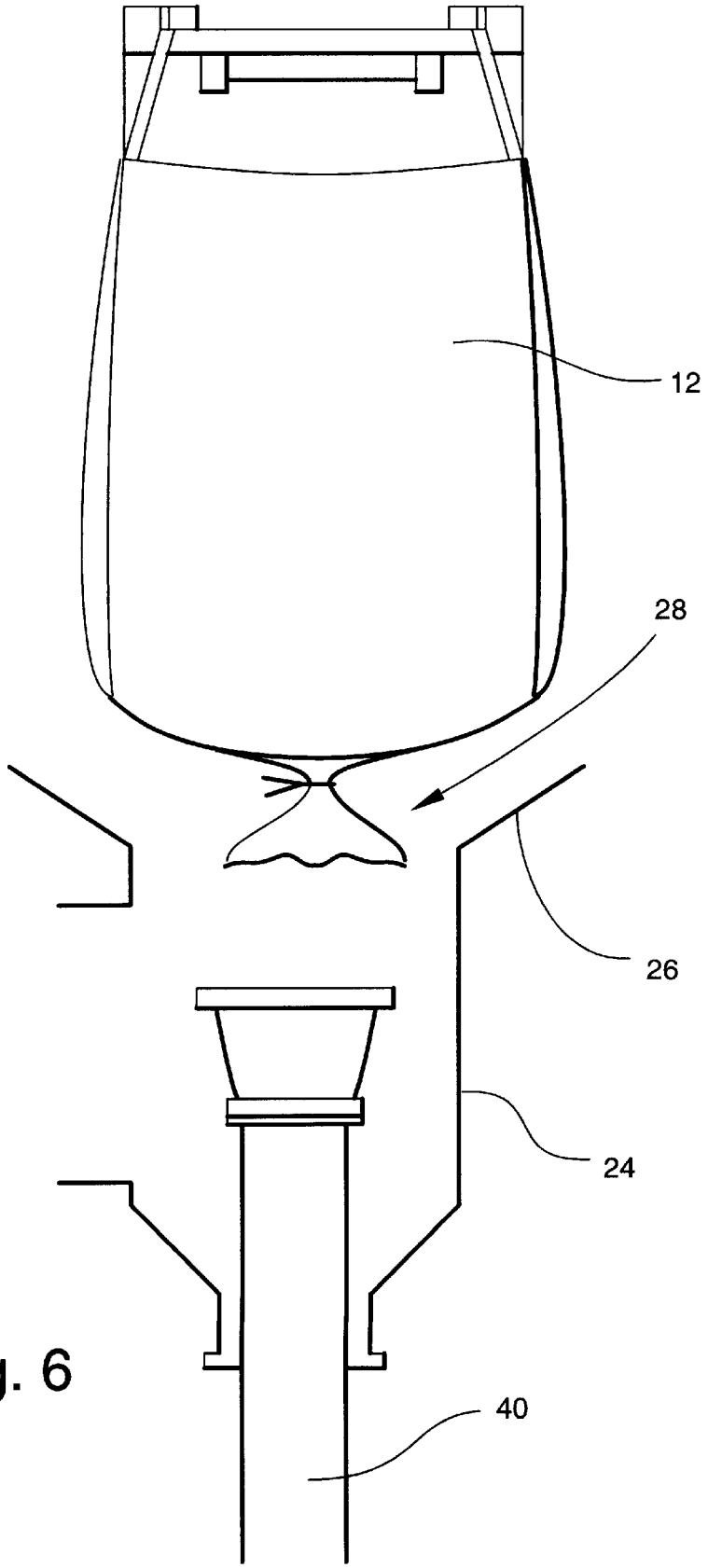
FIG. 6 is a schematic view of the outer chamber of FIG. 1 as a bag is lowered onto the outer chamber.
Figure 7:
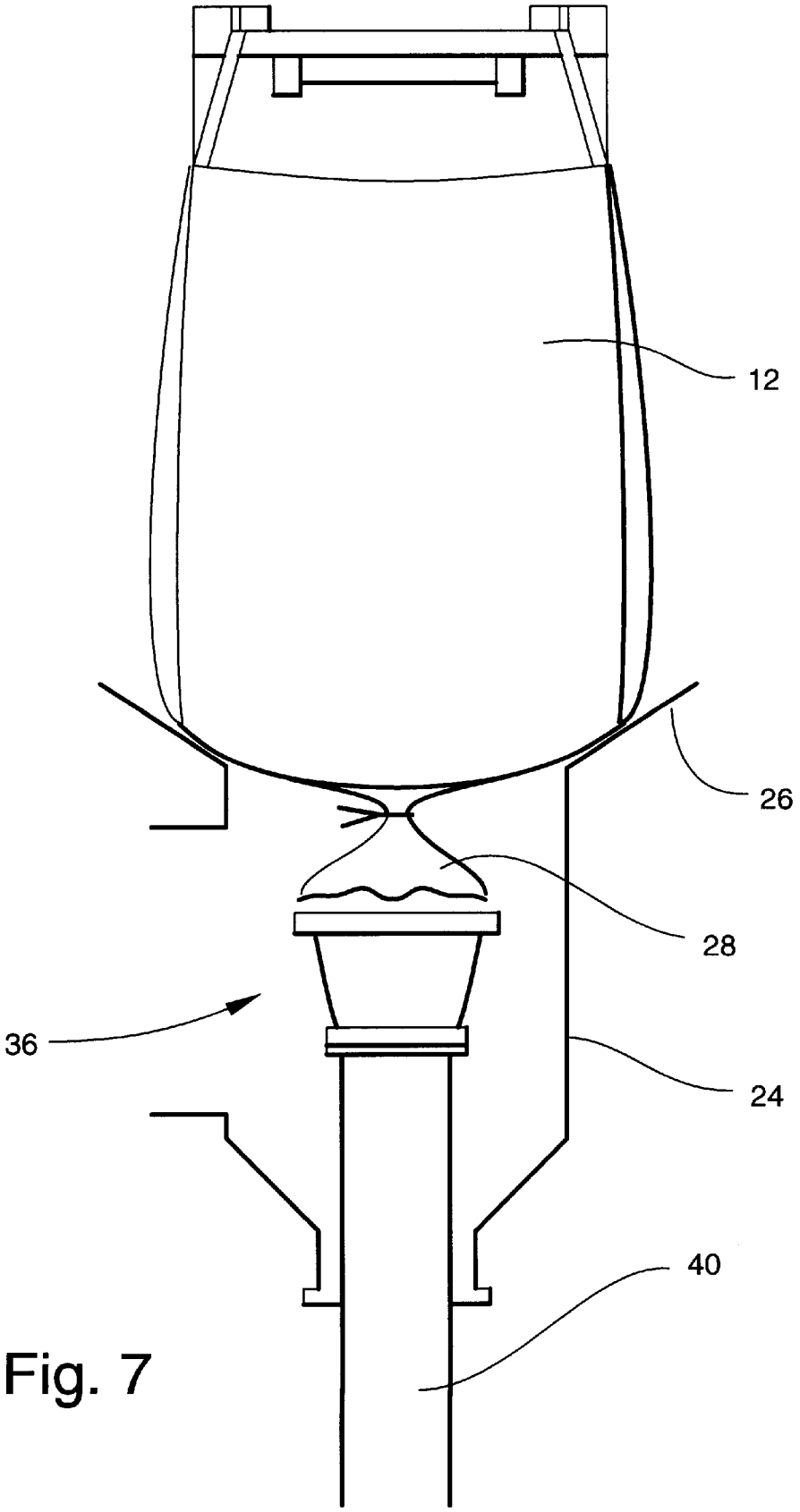
FIG. 7 is a schematic view of a bag in place on the outer chamber of FIG. 1.

In operation, as illustrated in FIGS. 1, 6 and 7, the loops 14 of the bulk bag 12 are fitted over the bag lifting frame 16 and elevated with a forklift or hoist (not shown) in position over the bag support dish 26 and lowered onto the dish 26 with the bag spout 28 passing through a center opening in the dish 26. Simultaneously, the bag lifting frame 16 is placed on top of the spring-loaded side tensioning frame 18, causing the frame 18 to compress between about 6 inches and about 18 inches.

Figure 8:
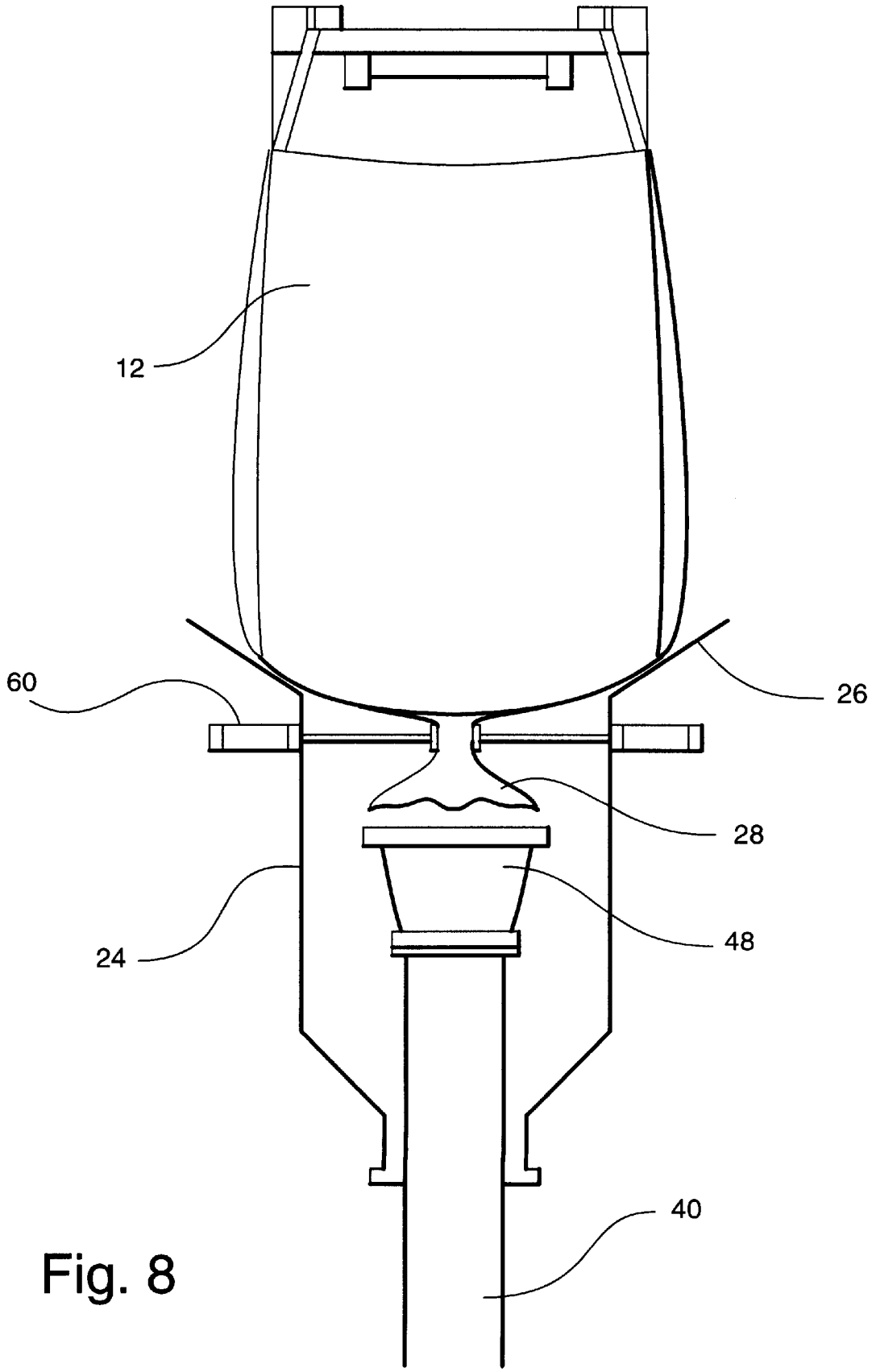
FIG. 8 is a schematic view of a bag in place on the outer chamber of FIG. 1 employing pinch bars.

The operator 39 then opens the access hatch 38 and grasps the bag spout 28, pulling downward, and unties the bag spout 28 and pulls it fully down and out so as to spread beyond the diameter of the spout adapter 48. The operator then reaches up into the bag spout 28 and pulls down the bag liner 56. If pinch bars 60 are employed, at this point the bag spout 28 is pinched closed by the pinch bars 60 (see FIG. 8).

Figure 9:
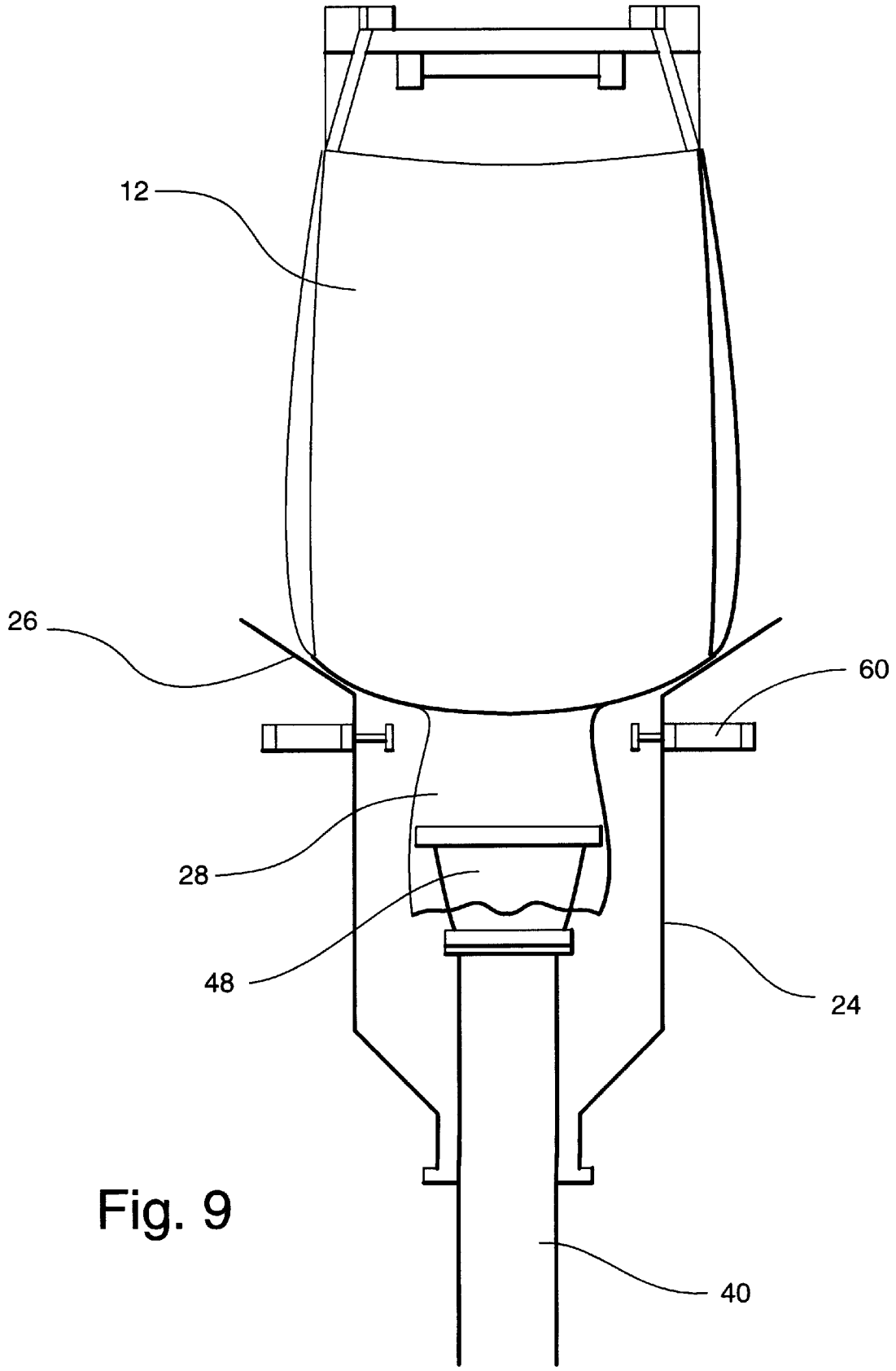
FIG. 9 is a schematic view of the outer chamber of FIG. 8 with the pinch bars disengaged.

The operator 39 then removes the spout adapter cover 58, unties the bag liner 56, and simultaneously pulls the liner 56 down and over the outside of the spout adapter 48. The spout adapter clamp 50 is then placed around the liner 56 and secured to the spout adapter 48 at the clamp connection 52 by the spout adapter clamp 50. Then the access hatch 38 is closed and secured. If pinch bars 60 are employed, at this point the pinch bars 60 are retracted (see FIG. 9).

Product 11 can now be withdrawn from the bag 12 through the inner product tube 40 into whatever device the user has attached to the opposite end of the inner product tube 40 (conveyor, hopper, or other process device). If the bag massage device 62 is employed, it may be utilized at this time to assist in the promotion of the flow of the product 11. As the product 11 flows out from the bag 12, the spring-loaded side tensioning frame 18 expands and provides vertical stretching of the bulk bag 12 to form a steeper angle on the bag bottom and to promote gravity flow of the product 11 remaining in the bag.

After all or nearly all of the product 11 has been removed from the bag 12, the device can be easily disassembled for cleaning. If the pinch bars 60 are employed, they may at this time be extended to pinch close the bag spout 28. The operator 39 opens the access hatch 38, removes the liner clamp 54, and reties the bag spout 28. If the pinch bars 60 are employed, they may now be retracted.

The spout adapter cover 58 is replaced on top of the spout adapter 48 to prevent introduction of any foreign materials. The bulk bag 12 may now be removed from the bag support dish 26. The inner product tube 40 is disconnected from the end process, and the spout adapter clamp 50 and spout adapter 48 are removed from the inner product tube 40. The inner product tube clamp 44 is then removed, and the inner product tube 40 is removed from the outer chamber 24.

The interior of the outer chamber 24 may now be swept dry or washed according to commonly accepted cleaning procedures. All solids can be swept out of the outer chamber 24 or liquids drained from the outer chamber 24 so that the interior of the outer chamber 24 meets required cleanliness standards.

Figure 10:
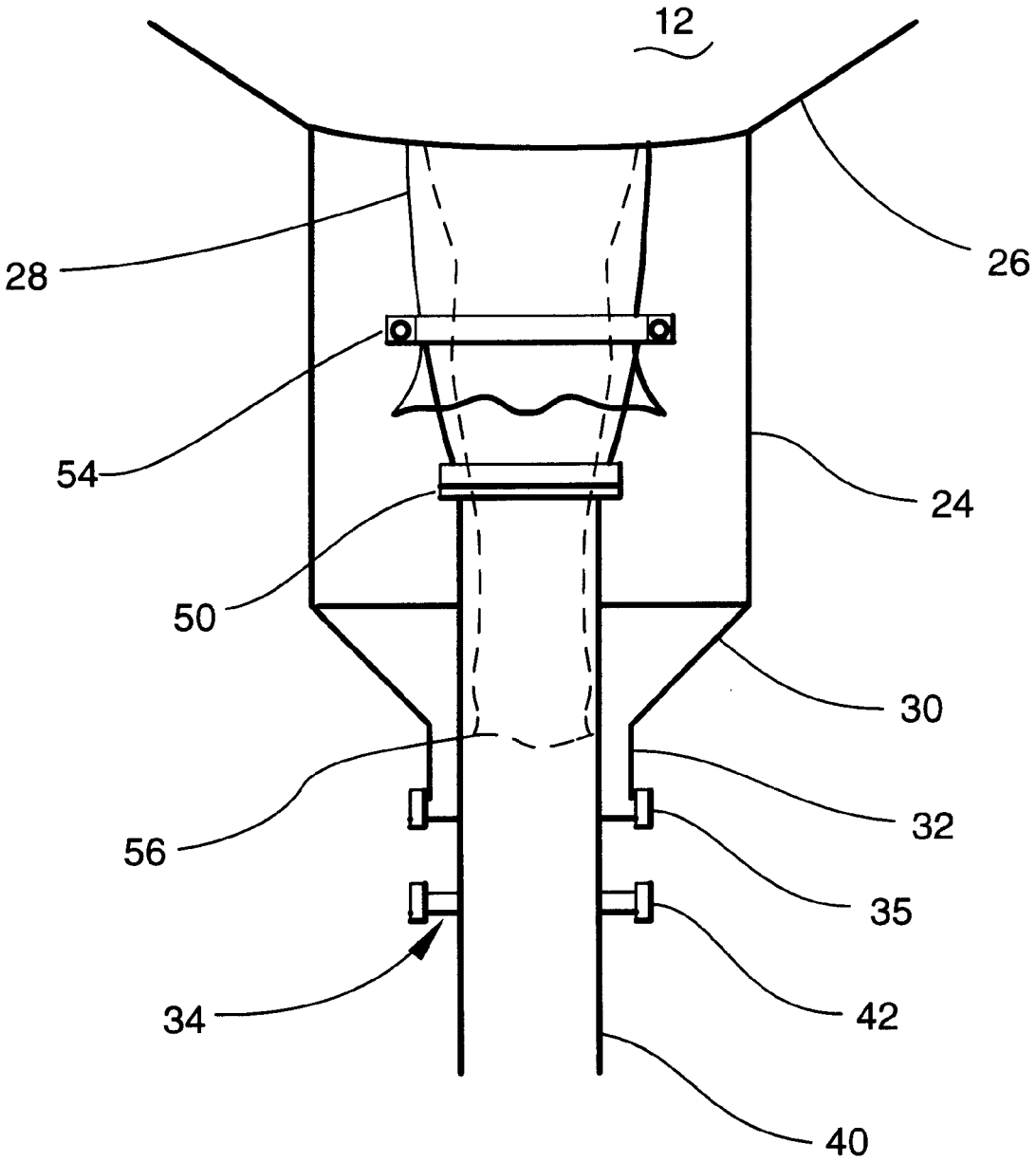
FIG. 10 is a cross-sectional view illustrating another embodiment of the present invention.

In another embodiment of the present invention, as illustrated in FIG. 10, the bag liner 56 is pulled into the interior of inner product tube 40. The bulk bag spout 28 is then clamped or otherwise secured to the clamp connection 52 on the top of the spout adapter 48 by spout adapter clamp 50.

Figure 3:
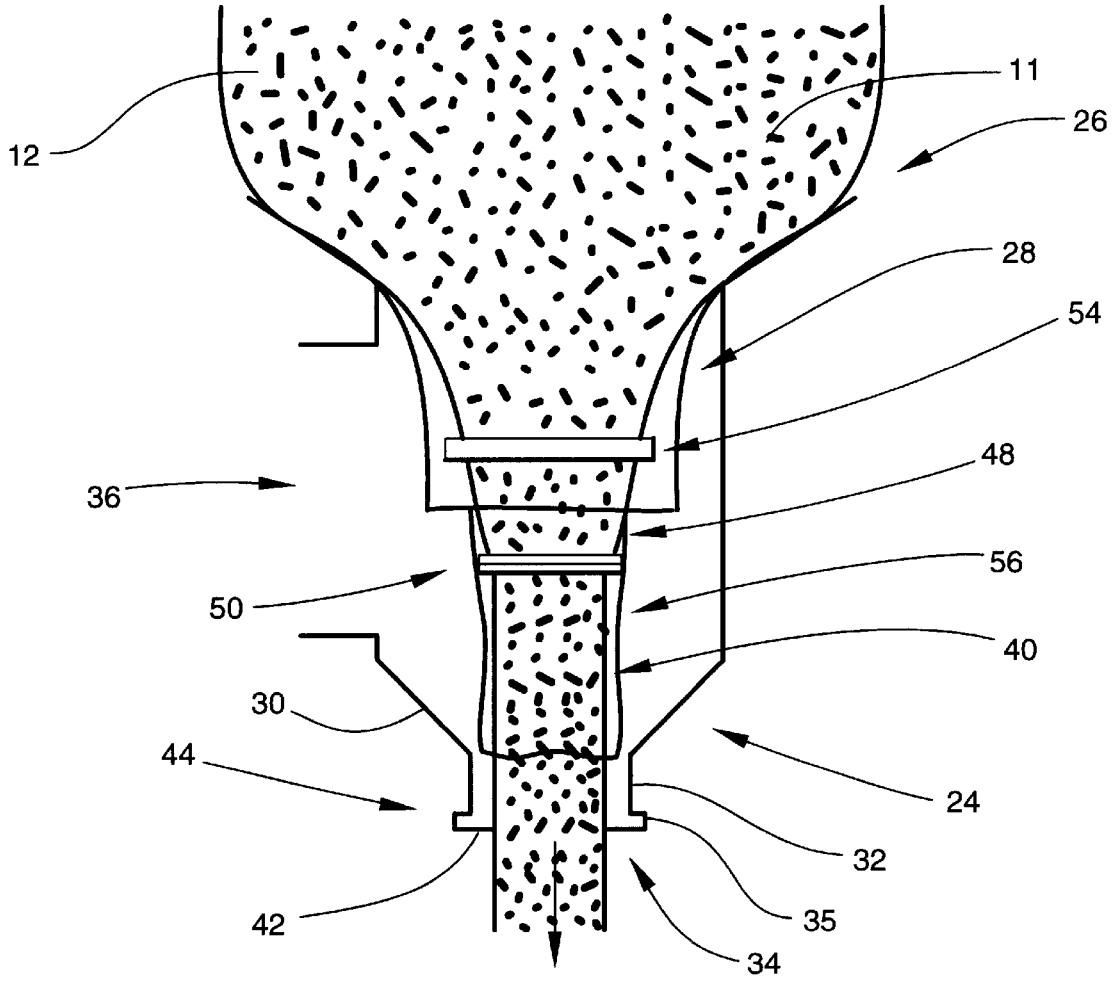
FIG. 3 is a cross-sectional view of the interior of the outer chamber taken along line 3—3 of the system of FIG. 1.
Figure 4:
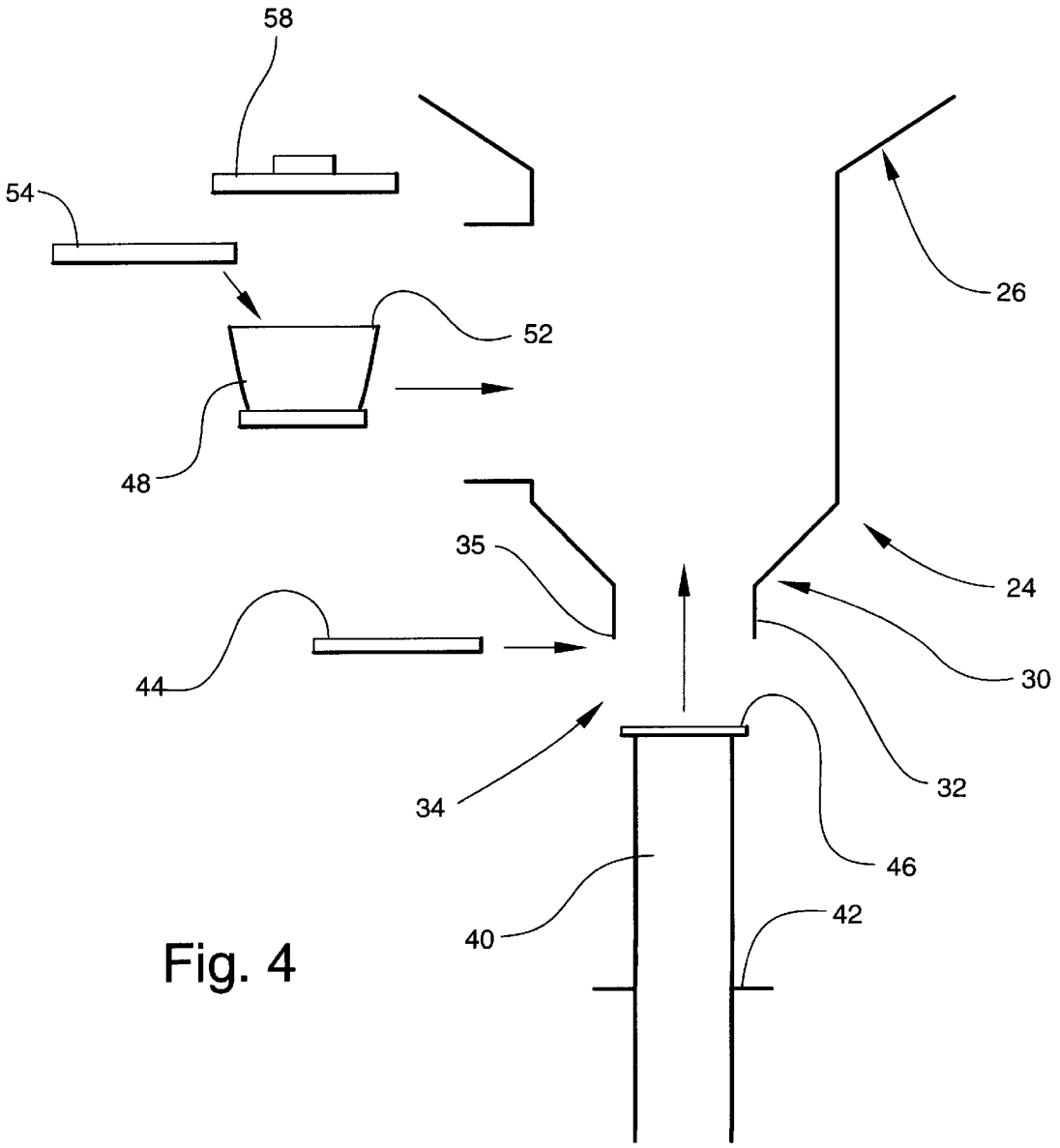
FIG. 4 is an exploded view of the components of FIG. 3.
Figure 5:
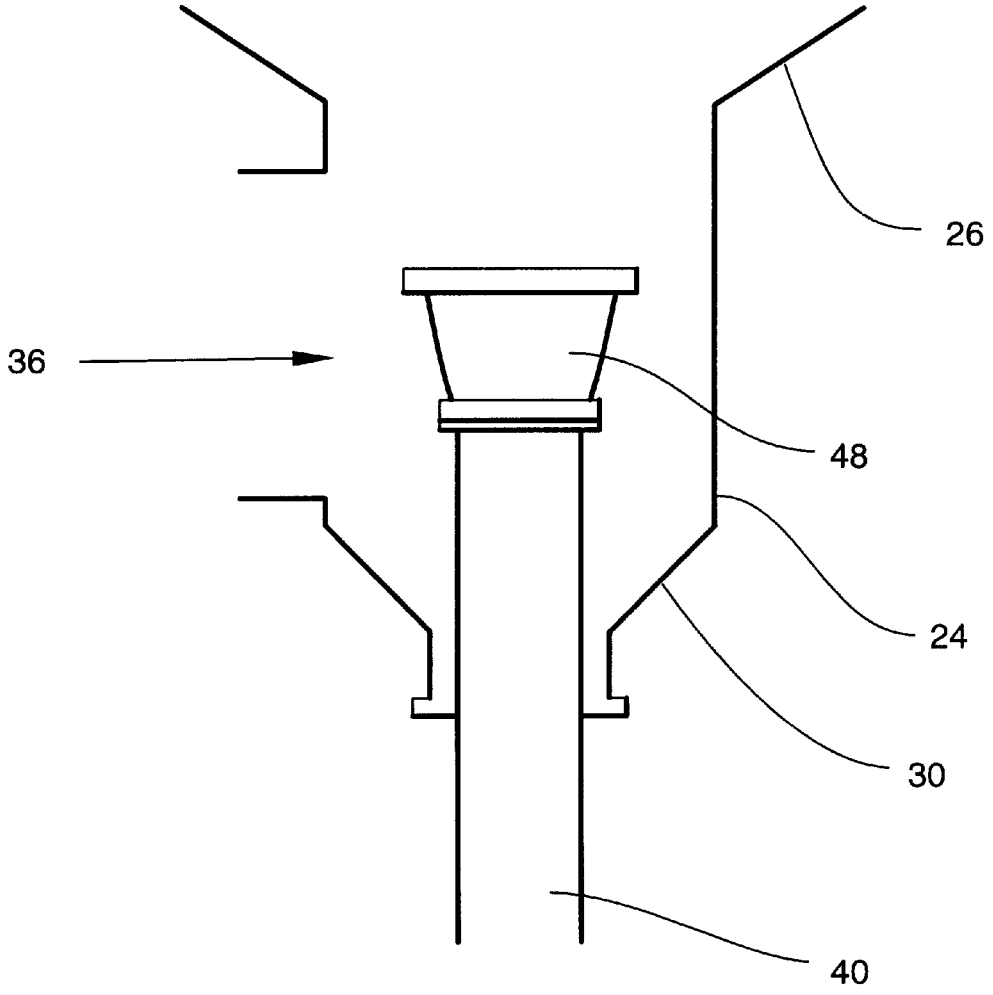
FIG. 5 is a view of the assembled components of FIG. 4.

As most clearly seen in FIG. 3, the system and process of the present invention allow for sanitary delivery of product 11I contained within the bulk bag 12. Initially, any debris contained on the outside of the bag 12 may fall into the interior of the outer chamber 24 when the bulk bag spout 28 is placed in the center of the bag support dish 26 (see FIGS. 6 and 7). However, the presence of the spout adapter cover 58 to prevent any undesirable material from entering the inner product tube 40 prevents this contamination from entering into the product zone, which is the interior of inner product tube 40. When the bag spout 28 is untied, any further debris contained within the bag and outside of the bag liner 56 will also fall into the bottom of the interior of the outer chamber 24 and not into the inner product tube 40 because of the spout adapter cover 58. When the bag liner 56 is pulled down, the cover 58 is still in place, preventing the introduction of any foreign material into the inner product tube 40. Then the cover 58 is removed, the bag liner 56 untied and spread over and around the spout adapter 48, and the liner clamp 54 then secures the liner 56 to the top of the spout adapter 48, such that product 11 from within the bag liner 56 will now discharge into inner product tube 40. Any foreign materials that may have been trapped on the outside of the bag 12, on the inside of the bag 12, or on the outside of the bag liner 56 will have fallen into the bottom of the outer chamber 24 and will not be entrained with the material being discharged from the bulk bag 12 into and through the inner product tube 40. Thus, a higher sanitation level is maintained for the discharge of the product 11 from within the bulk bag 12.

It will be obvious to one of ordinary skill in the art that a wide variety of materials may be used to construct the system described herein. Particularly suitable is 300 series stainless steel. The internal surface finishes have the welds ground smooth, flush, and crevice free, with a 180 grit finish. External welds are also ground smooth, not flush, but crevice free with a glass bead (virgin 200 micron) blasted finish or #4, 150–180 grit finish. The bulk bag discharge system and method described herein generally meet the United States Department of Agriculture's standards for cleanliness and sanitary discharge of bulk materials and comply with Dairy Industry 3A sanitary requirements. It is noted that, while the system and method of the present invention are particularly suited for those bulk food materials requiring a high level of sanitation, the invention described herein is also well suited for applications in which cross-contamination from one discharge bag to the next must be minimized. This is the case for reactive chemicals, pigments, dyes, inks, catalysts, and semiconductor materials, for example. It will also be noted that the advantageous feature of the ease with which the system may be disassembled and cleaned is particularly applicable where hazardous materials, carcinogens, or other solid chemicals that are hazardous to human health are being discharged, such that these residual materials may then easily be cleaned out of the bag discharge system with minimum human contact. Conventional bag discharge systems are not easily disassemblable and are much more difficult to adequately clean.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A bulk bag discharge apparatus for discharging with little or no contamination the contents of a bag having a discharge spout and having an inner liner formed with a product discharge portion positioned within said discharge spout, said apparatus comprising:

(a) a frame for supporting said bag at an elevated position with said discharge spout and said inner liner discharge portion positioned at the bottom end of said elevated bag;

(b) a discharge chamber located beneath said bag and having an open upper end for engaging said bag, and also having a selectively openable access hatch therein for permitting access to the interior of said discharge chamber;

(c) an inner product tube having an inlet end positioned within said discharge chamber and beneath said open upper end thereof and a discharge end extending outside of said discharge chamber in sealed relation thereto, said inner product tube having a cover disposed over said inlet end thereof that is selectively removable from said inner product tube;

(d) clamping means located within said discharge chamber adjacent said access hatch for clamping said bag to said inlet end of said inner product tube in sealed relation thereto for permitting the contents of said bag to flow through said inner product tube while preventing the ingress of any contaminants into said flow of contents from outside said inner product tube.

2. A bulk bag discharge apparatus as defined in claim 1 wherein said clamping means clamps said product discharge portion of said bag inner liner around the exterior of said inlet end of said inner product tube.

3. A bulk bag discharge apparatus as defined in claim 1 wherein said clamping means clamps said discharge spout of said bag around the exterior of said inlet end of said inner product tube.

4. A bulk bag discharge apparatus as defined in claim 1 wherein second clamping means are provided for removably clamping said inner product tube to said discharge chamber, whereby said inner product tube can be removed for cleaning.

5. A bulk bag discharge apparatus as defined in claim 1 wherein said open upper end of said discharge chamber is formed with a frustoconical support dish for supporting said bag thereon.

6. A method of discharging the contents of a bag with little of no contamination of such contents, said bag having a discharge spout and an inner liner formed with a discharge portion within said discharge spout, and said bag having a tie to prevent said contents of said bag from being discharged therefrom, said method comprising the steps of:

(a) supporting said bag at an elevated position with said discharge spout and said inner liner discharge portion positioned at the bottom end of said elevated bag;

(b) positioning a discharge chamber beneath said bag and providing an opening in said chamber to provide access to the interior thereof;

(c) positioning a product tube within said discharge chamber so that an inlet end of said product tube is positioned beneath said discharge spout and said inner liner discharge portion and so that an outlet end of said product tube extends outside said discharge chamber in sealed relation thereto, said product tube having a removable cover covering said inlet end thereof;

(d) temporarily pinching said discharge spout and said discharge portion of said inner liner above said ties;

(e) manually reaching through said access opening to release said tie, to remove said cover, and to clamp said discharge portion of said inner liner about the exterior of said inlet end of said product tube in sealed relation thereto; and (f) discontinuing said pinching of said discharge spout and said discharge portion of said inner liner to permit said contents of said bag to be discharged through said product tube.

7. A method of discharging the contents of a bag with little of no contamination of such contents, said bag having a discharge spout and an inner liner formed with a discharge portion within said discharge spout, and said bag having a tie to prevent said contents of said bag from being discharged therefrom, said method comprising the steps of:

(a) supporting said bag at an elevated position with said discharge spout and said inner liner discharge portion positioned at the bottom end of said elevated bag;

(b) positioning a discharge chamber beneath said bag and providing an opening in said chamber to provide access to the interior thereof;

(c) positioning a product tube within said discharge chamber so that an inlet end of said product tube is positioned beneath said discharge spout and said inner liner discharge portion and so that an outlet end of said product tube extends outside said discharge chamber in sealed relation thereto, said product tube having a removable cover covering said inlet end thereof;

(d) temporarily pinching said discharge spout and said discharge portion of said inner liner above said ties;

(e) manually reaching through said access opening to release said tie, to remove said cover, and to position said discharge portion of said inner liner within said product tube and to clamp said discharge spout of said bag about the exterior of said inlet end of said product tube in sealed relation thereto; and (f) discontinuing said pinching of said discharge spout and said discharge portion of said inner liner to permit said contents of said bag to be discharged through said product tube.

* * * * *